United States Patent [19]
Angelo et al.
[11] 4,348,780
[45] Sep. 14, 1982

[54] APPARATUS FOR ELEVATING A MOBILE RIG

[75] Inventors: Lawrence F. Angelo, Conroe; Frank A. Bryant; John D. McLain, both of Houston, all of Tex.

[73] Assignee: WellTech, Inc., Houston, Tex.

[21] Appl. No.: 152,790

[22] Filed: May 23, 1980

[51] Int. Cl.[3] ..... E01D 1/00
[52] U.S. Cl. ..... 14/1; 14/71.3; 14/71.7; 414/13; 52/175
[58] Field of Search ..... 14/71.1, 69.5, 71.7, 14/71.3; 414/333, 334, 13; 52/175

[56] References Cited

U.S. PATENT DOCUMENTS

| | | | |
|---|---|---|---|
| 2,643,010 | 6/1953 | Hott | 14/69.5 X |
| 2,711,804 | 6/1955 | Woolslayer | 52/175 X |
| 2,786,590 | 3/1957 | Edwards | 414/333 X |
| 2,815,872 | 12/1957 | Graham | 14/69.5 X |
| 2,855,115 | 10/1958 | Casey | 414/333 X |
| 3,409,923 | 11/1968 | Walker | 14/71.7 |
| 3,599,382 | 8/1971 | Stone | 14/71.1 X |
| 3,872,948 | 3/1975 | Richards | 14/71.1 X |
| 3,881,207 | 5/1975 | Jones | 14/69.5 |

*Primary Examiner*—Nile C. Byers, Jr.

[57] ABSTRACT

This invention relates to apparatus for elevating a mobile workover rig to an elevated operating position proximate wellhead. It includes a portable platform arranged for positioning proximate the wellhead with the platform having a fixed generally horizontal upper surface portion for receiving and supporting the wheels of the rig thereon. It also includes ram means comprising two longitudinally aligned portions connected to the platform for forming an inclined ramp extending from the upper surface of the platform to the ground for moving the rig thereonto. It also includes means connected to the ramp means for raising at least one of the portions of the rig to an elevated generally horizontal position substantially the same height as the upper surface of the platform while wheels of the rig are supported thereon to thereby elevate and support the rig in the elevated operating position.

5 Claims, 5 Drawing Figures

APPARATUS FOR ELEVATING A MOBILE RIG

Apparatus for elevating a mobile rig positioned adjacent to a structure to an elevation above the ground level that includes a rear ramp adapted for supporting the rig positionable adjacent to the structure. The rear ramp has a forward end and a rearward end and is movable from a first position, wherein the rearward end is proximate to the ground, to a second position wherein the forward and rearward ends are substantially level at the same elevation above the ground.

BACKGROUND OF THE INVENTION

A. Field of the Invention

This invention relates to apparatus for positioning a mobile rig adjacent to a structure, and more particularly to apparatus for elevating the rig to an elevation above ground level.

B. Background of the Prior Art

At times during the life of an oil and gas well, it is necessary to perform workover operations. Workover operations are frequently performed by positioning over the wellhead a structure on which workmen may work and positioning adjacent to the structure a rig having a mast for running equipment in and out of the well.

In certain locations, wellheads are exceedingly tall, and available structures do not have sufficient clearance thereunder to clear the wellhead. It is possible to provide higher structures, but commercially available self-propelled carrier rigs do not have masts tall enough to allow operation between the surface of the platform and the top of the mast. One solution would be to procure a rig with a longer mast, but such rigs are not available. Another solution would be to elevate the rig, as for example by placing a platform adjacent to the structure with a ramp extending laterally away therefrom.

Self-propelled rigs must be substantially level when they are in operation. This would require a level platform of substantially the same length as the rig. Since mobile rigs are limited in the incline up which they can travel, a relatively long ramp would be required. The combination of a platform and a ramp would have a length approximately twice that of the rig and in order to line up the rig for travel up the ramp, a space of at least three, and more probably four, rig lengths away from the wellhead is necessary. In a number of instances, such space simply is not available. Additionally, in order to transport a ramp and platform, extra equipment-carrying capacity is required.

SUMMARY OF THE INVENTION

It is therefore an object of the present invention to provide apparatus for elevating a mobile rig to an elevation above the ground level that requires a minimum of space and equipment.

Briefly stated, the foregoing and other objects of the present invention are accomplished by providing an apparatus which includes a rear ramp adapted for supporting a rig positionable adjacent to the structure that has forward and rearward ends and is movable from a first position wherein the rearward end is proximate to the ground, to a second position where the forward and rearward ends are substantially level and at the required elevation above the ground level. Means are provided for moving the ramp between the first position and the second position.

The apparatus also includes a forward platform positionable between the structure and the forward end of the rear ramp. The forward platform has a forward end that is adapted for attachment to the structure and a rearward end. The forward platform has a substantially level portion adapted for supporting the rig at the required elevation above the ground.

The apparatus also includes an inclined intermediate ramp positionable between the forward platform and the rear ramp. The intermediate ramp has a forward end positionable proximate to the rearward end of the forward platform and a rearward end positionable proximate to the forward end of the rear ramp when the rear ramp is in the first position.

DESCRIPTION OF THE PREFERRED EMBODIMENT

Figures 1, 2:
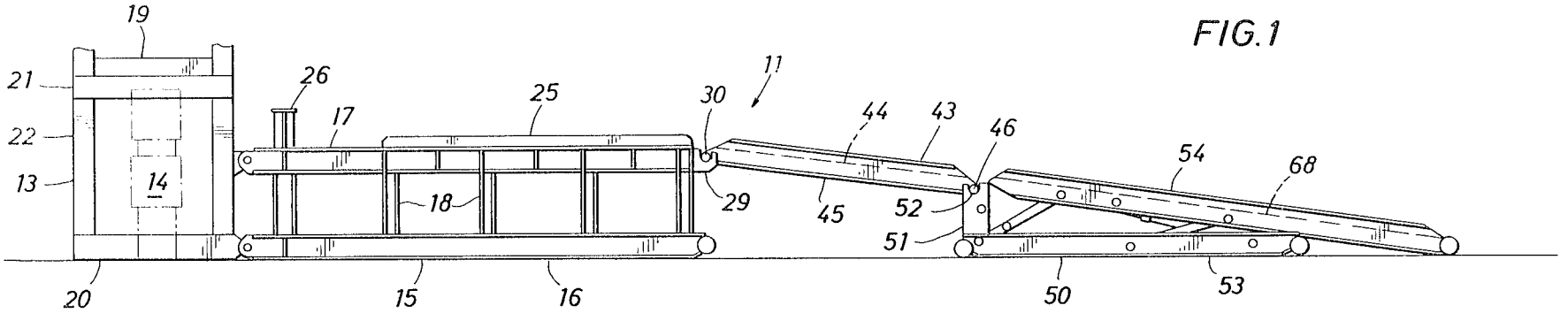
FIG. 1 is a side elevation view of the apparatus of the present invention pinned to the subbase of the structure, wherein the rearward ramp is in the first, inclined, position.
FIG. 2 is a side elevation view of the apparatus of the present invention showing the rearward ramp in the second, level, position with a mobile rig supported thereon.

Referring now to the drawings, the apparatus of the present invention is designated generally by the numeral 11 and includes a forward platform 15, an intermediate ramp 45, and a rearward ramp 50.

Forward platform 15 includes a base portion 16, which is adapted for supporting forward platform 15 upon the ground, and a level upper support portion 17 adapted for supporting a mobile rig, designated by the numeral 12 in FIG. 2. Upper support portion 17 and base portion 16 are connected together by a set of braces 18 which are of sufficient strength to support rig 12 on upper support portion 17.

Upper support portion 17 and base portion 16 are pinned to a structure which includes subbase 13 which is adapted for placement over a wellhead 14. Subbase 13 serves to elevate a telescoping substructure 19 above wellhead 14. Subbase 13 includes a base 20 and a top 21 rigidly connected together by legs 22. Telescoping substructure 19 includes a work platform 23 supported on telescoping legs 24.

Forward platform 15 is wide enough to accommodate mobile rig 12 and upper support portion 17 may conveniently include a pair of track sections. Upper support portion 17 includes guide rails 25 which constrain the front wheels 28 of mobile rig 12 as it is being positioned.

Forward platform 15 has at its forward end a step 26, which supports and transmits to the ground the weight and hook load of mast 27 of mobile rig 12. Forward platform 15 has at its rearward end means 29 for attaching the forward end of intermediate ramp 45 thereto. In the preferred embodiment, attachment means 29 include a gussett plate having a notch therein for supporting a pin 30 rigidly attached to intermediate ramp 45.

Intermediate ramp 45 is substantially as wide as forward platform 15 and may include a pair of parallel track sections. Intermediate ramp 45 includes a bed, shown in phantom as 44 in FIG. 1, and rails 43 for accommodating front wheels 28 of rig 12 as rig 12 travels upwardly thereon.

Intermediate ramp 45 slopes downwardly toward a rearward end which is supported by a pair of posts 51 rigidly attached to rearward ramp 50. Intermediate ramp 45 is supported on post 51 by pins 46 that engage notches 52 on posts 51.

Rearward ramp 50 includes a base 53 and a ramp section 54 movably connected to base section 53. Ramp section 54 is movable from a sloping first position as shown in FIG. 1 to a substantially level second position as shown in FIG. 2.

Figure 3:
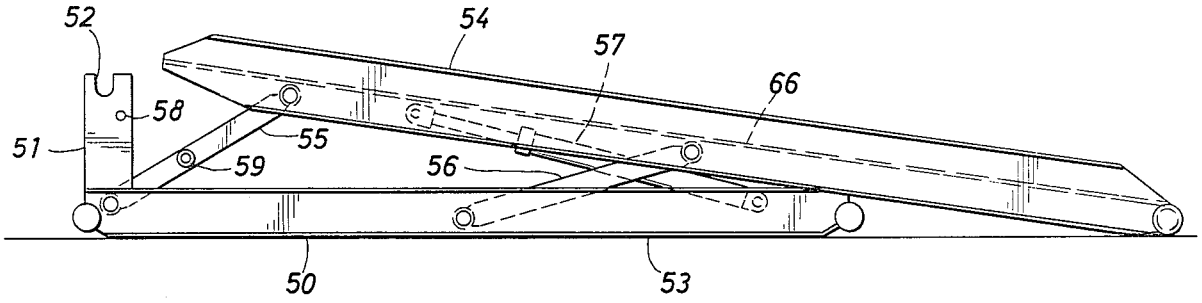
FIG. 3 is a side elevation view of the rearward ramp of the present invention in the first position.
Figure 4:
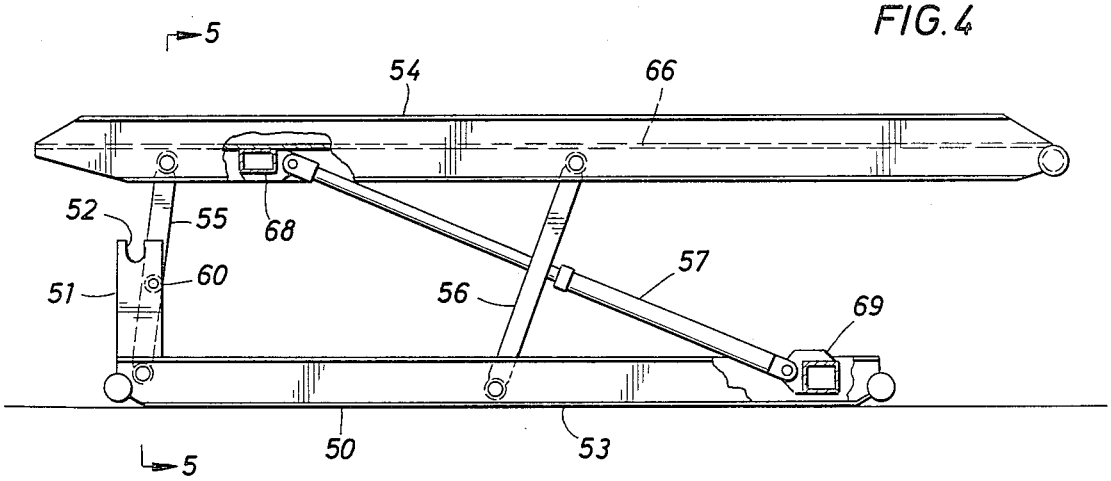
FIG. 4 is a side elevation view of the rearward ramp of the present invention in the second position.

Referring now to FIGS. 3 and 4, base 53 and ramp section 54 are connected together by pairs of legs designated 55 and 56 pivotally connected therebetween. The lengths and attachment points of legs 55 and 56 are such that ramp section 54 is movable between the sloping position of FIG. 3 and the level position of FIG. 4. An hydraulic linear actuator 57 is pivotally connected between a brace 68 in ramp section 54 and a brace 69 in base 53 to move ramp section 54 between the sloping and level positions.

Figure 5:
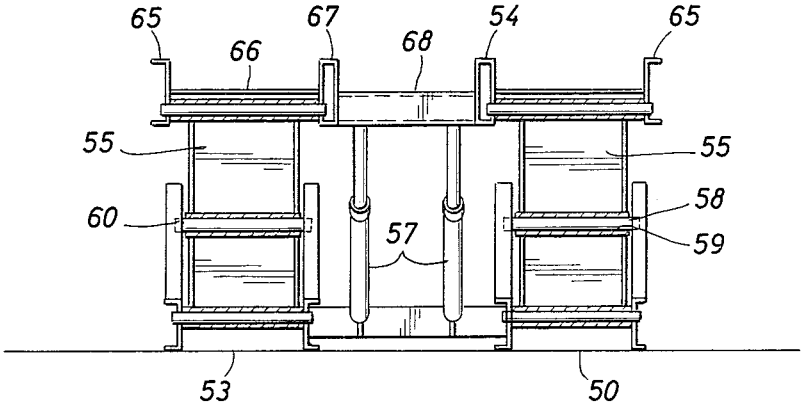
FIG. 5 is a view taken along line 5—5 of FIG. 4 showing details of the rearward ramp of the present invention.

In order to lock ramp section 54 in the level position, posts 51 and legs 55 are provided with holes, designated 58 and 59 respectively as shown in FIG. 5. When ramp section 54 is in the level position holes 58 and 59 line up and a pin 60 may be inserted therethrough.

As shown in FIG. 5, rearward ramp section 54 preferably comprise a pair of channels 65, which include a bed 66 and a pair of rails 67. Channels 65 are connected together for stability by bracing, as for example brace 68.

In operation, subbase 13 is first placed over wellhead 14 and forward platform 15 is spotted adjacent thereto. The distance from the centerline of wellhead 14 to forward platform 15 is critical so that the top of mast 27 is substantially perfectly aligned with wellhead 14. When forward platform 15 is properly positioned, platform 15 and subbase 13 are pinned together as shown in FIGS. 1 and 2. Rearward ramp 50 is then spotted behind forward platform 15 and intermediate ramp 44 is placed therebetween. With ramp section 54 in the first position, rig 12 is winched up ramp section 54 and intermediate ramp 45 until front wheels 28 of rig 12 are positioned properly upon forward ramp 15. When front wheels 28 are properly positioned, rear wheels 65 of rig 12 will have been pulled upon ramp portion 54 of rearward ramp 50 while ramp 50 was in its sloping position. Then, hydraulic actuator 57 is actuated to move ramp 54 from the sloping position to the level position, as shown in FIG. 2, whereupon pins 60 are inserted through holes 58 and 59, which are aligned, to lock ramp section 54 in the level position. After ramp section 54 has been locked in place, pressure to hydraulic actuator 57 may be relieved. After rig 12 is properly secured and leveled as shown in FIG. 2, mast 27 is raised. Telescoping substructure 19 is then placed on top of subbase 13 and telescoping legs 24 are jacked to the proper height.

It is thus apparent that the present invention provides an apparatus that overcomes the shortcomings of the prior art. Forward platform 15, intermediate ramp 45 and rearward ramp 50 can be transported to the well site with a minimum of equipment. When the apparatus is assembled on the site, its length is substantially the same as that of rig 12, thereby requiring no additional space around wellhead 14.

Further modifications and alternative embodiments of the apparatus of this invention will be apparent to those skilled in the art in view of this description. Accordingly, this description is to be construed as illustrative only and is for the purpose of teaching those skilled in the art the manner of carrying out the invention. It is to be understood that the form of the invention here as shown and described is to be taken as the presently preferred embodiment, various changes may be made in the shape, size and arrangement of parts, for example, equivalent elements or materials may be substituted for those illustrated and described herein, parts may be reversed, and certain features of the invention may be utilized independently of the use of other features, all as would be apparent to one skilled in the art after having the benefit of this description of the invention.

What is claimed is:

1. Apparatus for elevating a mobile workover rig to an elevated operating position proximate a wellhead, said apparatus comprising:

a portable platform arranged for positioning proximate said wellhead, said platform having a fixed generally horizontal upper surface portion for receiving and supporting wheels of said rig thereon;

ramp means comprising two longitudinally aligned portions connected to said platform for forming an inclined ramp extending from said upper surface portion of said platform to the ground for moving said rig thereonto;

and means connected to said ramp means for raising at least one of said portions of said ramp means to an elevated generally horizontal position substantially the same height as said upper surface of said platform while wheels of said rig are supported thereon to thereby elevate and support said rig in said elevated operating position.

2. Apparatus for elevating a mobile rig positioned adjacent to a structure to an elevation above the ground level, which comprises:

a portable first ramp adapted for supporting said rig and positionable adjacent to said structure, said first ramp having a forward end and a rearward end with said rearward end being spaced more distant from said structure than said forward end, said first ramp being movable from a first position wherein said rearward end is proximate to said ground level to provide an inclined ramp to a second position wherein said forward and rearward ends are substantially at said elevation above said ground level;

means connected to said first ramp for moving said first ramp between said first and second positions;

a portable forward platform positionable between said structure and said forward end of said first ramp, said forward platform having forward and rearward ends, said forward end being adapted for attachment to said structure and said forward platform having a substantially level portion adapted for supporting said rig at said elevation above said ground level;

an inclined portable intermediate ramp positionable between said forward platform and said first ramp, said intermediate ramp having forward and rearward ends, said forward end positionable proximate to said rearward end of said forward platform and said rearward end positionable proximate to said forward end of said first ramp when said first ramp is in said first position, wherein the slope of said intermediate ramp is substantially the same as the slope of said first ramp when said first ramp is in said first position;

said first ramp including a base having forward and rearward ends, a support for supporting said rig, forward legs pivotally connected between said base and said upper support; and rearward legs pivotally connected between said base and said upper support, wherein the lengths and positions of attachment of said forward and rearward legs are such that said upper support is pivotal between said first position and said second position;

said moving means including hydraulic cylinder means connected between said base and said upper support;

means for locking said upper support in said second position, including post means attached to said forward end of said base;

and means associated with said post means for pinning said forward legs to said post means.

3. The apparatus as claimed in claim 2, including means for connecting said rearward end of said intermediate ramp to said post.

4. Apparatus for working over a well having a wellhead, which comprises:

a portable structure positionable over said wellhead, said structure including a subbase positionable over said wellhead and a substructure mounted over said subbase;

a portable platform having forward and rearward ends, said forward end being pinned laterally adjacent to said structure, said platform having a substantially level support portion at the top thereof;

a portable ramp spaced laterally apart from said platform, said ramp having forward and rearward ends, said ramp being movable between a sloping position and a level position, wherein said ramp is in said sloping position when said rearward end thereof is adjacent to the ground;

a sloping intermediate portable ramp positioned between and connected to said platform and said ramp, said intermediate ramp having a forward end adjacent to said rearward end of said level support portion of said forward platform and a rearward end adjacent to said forward end of said ramp when said ramp is in said sloping position;

and means connected to said portable ramp for moving said ramp from said sloping position to said level position.

5. The apparatus as claimed in claim 4, wherein said substructure includes telescoping legs.

* * * * *